United States Patent [19]

Elbe

[11] 4,308,727

[45] Jan. 5, 1982

[54] BRILLIANT-CUT STONE

[76] Inventor: Maximo Elbe, Hebbelstrasse 8, 2 Hamburg 22, Fed. Rep. of Germany

[21] Appl. No.: 65,554

[22] Filed: Aug. 10, 1979

Related U.S. Application Data

[63] Continuation of Ser. No. 863,166, Dec. 22, 1977, abandoned, which is a continuation of Ser. No. 688,293, May 20, 1976, abandoned, which is a continuation of Ser. No. 486,088, Jul. 5, 1974, abandoned, which is a continuation-in-part of Ser. No. 256,912, May 25, 1972, abandoned.

[30] Foreign Application Priority Data

May 28, 1971 [DE] Fed. Rep. of Germany ..... 2126572

[51] Int. Cl.[3] ..... A63H 17/00

[52] U.S. Cl. ..... 63/32

[58] Field of Search ..... 63/32

[56] References Cited

U.S. PATENT DOCUMENTS

| | | | |
|---|---|---|---|
| 946,939 | 1/1910 | Gonard | 63/32 |
| 1,131,593 | 3/1915 | Bashor | 63/32 X |
| 2,009,390 | 7/1935 | Bayardi | 63/32 |
| 2,447,407 | 8/1948 | Grain | 63/32 |

FOREIGN PATENT DOCUMENTS

| | | | |
|---|---|---|---|
| 2126572 | 12/1972 | Fed. Rep. of Germany | 63/32 |

*Primary Examiner*—F. Barry Shay

*Attorney, Agent, or Firm*—Michael J. Striker

[57] ABSTRACT

A jewel of a brilliant type cut is made with facet angles with respect to the girdle plane as follows:

(1) A planar table at $\phi=0°$ (parallel of the girdle plane);

(2) a pair of angles for one or a plurality of bezel facet rings at $\phi_1$ and a pavilion facet ring at $\psi$, the pair of angles being within an intransparency triangle. The intransparency triangle is defined in the Cartesian coordinate system $y=\psi=0°$ to 90° above $x=\phi=0°$ to 90° on one side by the straight line $\phi=0°$, and on the other sides by the transcendental curves (a) $\epsilon_o=\phi-\alpha-\psi$ and (b) $\epsilon_o=180°-3\psi-\phi+\alpha$ respectively whereby $\epsilon_o$ is the sharp boundary of total reflection;

(3) another bezel facet ring at $\phi_2$ with angles between 50° and 90°; and (4) the range of the pavilion facet angles $\psi=25°$ to 51°.

12 Claims, 2 Drawing Figures

BRILLIANT-CUT STONE

This is a continuation, of application Ser. No. 863,166, filed Dec. 22, 1977 which in turn was a continuation of application Ser. No. 688,293, filed May 20, 1976, which in turn was a continuation of application Ser. No. 486,088, filed July 5, 1974, which in turn was a continuation-in-Part of application Ser. No. 256,912 of May 25, 1972 all now abandoned.

BACKGROUND OF THE INVENTION

The present invention relates to jewelry stones in general, and more particularly to brilliant-cut jewelry stones. It also relates to a method of cutting such stones.

Brilliants are gem stones, usually diamonds, European cut or the American cut, providing them with facets. The term brilliant which is given to gem stones cut in this manner refers to the fact that because of the special type of cut given them, they have a particularly brilliant and sparkling appearance. Generally speaking, a brilliant has a girdle, meaning the circumferential zone at which the upper portion of the stone, called the bezel, and the lower portion which is called the pavilion, join one another. Reference to upper and lower portions is clearly understood here, because the bezel has, in a plane which usually parallels the general plane of the girdle, a surface called the table which in the normal viewing position faces upwardly.

Brilliants of the cuts known heretofore have their facets which are provided on the pavilion, inclined with reference to the general plane of the girdle at angles of between 38.7° up to 40.9°. The upper facets, that is those provided on the bezel, are inclined to the general plane of the girdle at angles of between 25.5° up to 41.1°. The respective pair of angles meets the equation established in 1926 by A. Johnson, which gives for the particular material via the refraction index (n) those angles for the upper and lower facets which will afford the maximum possible reflection.

The invention disclosed in my copending application provides a substantial improvement over what has heretofore been accepted in this art. However, I have since found that I can provide such improvements not only in gem stones, i.e., precious stones, but also in other transparent materials which are used for costume jewelry and the like, for instance paste.

Therefore, the present invention relates also to transparent jewels made of natural and synthetic substances. Therein are determined the facet angles of the brilliant cut within narrow limits and deviating from the known commercial cuts to better utilize the rough stone on the one hand to preserve the brilliance of the brilliant on the other hand. Among the transparent materials diamond is the most valuable substance for which it is especially rewarding to preserve the material of the rough stone in the brilliant. Since in the commercial diamond brilliant cut quite specific proportions must be maintained and some rough diamonds are considerably different from the classical octahedral shape, it is required to cut away up to 67% of the valuable substance when the finished cut stone is to exhibit brilliance.

The brilliant cut is of characteristic shape. Initially square in its basic shape, it has developed in the course of two centuries to a round shape as full-cut brilliant with a predetermined number of facets and with quite specific facet angles. Above the girdle are disposed the crown or bezel facets at the facet angles, and these facets are delimited by a table which is parallel to the girdle. The height of the upper portion of the diameter of the table with respect to the girdle are determined within very narrow limits if the brilliant is to exhibit a convincing brilliance. The facet angles of the rear portion below the girdle are in commercial cuts in still narrower limits than the above cited bezel facet angles. This type of cut is supposed to achieve the optical optical object of reflecting all light that is incident upon the brilliant at the pavilion facets thereof, in order to emit this light through the table and the bezel facets toward the viewer. A large number of such reflections shall impress the viewer. The light which is emitted rearwardly through the pavilion facets reduces the number of reflections.

SUMMARY OF THE INVENTION

It is, accordingly, an object of the present invention to provide a brilliant-cut jewelry stone of transparent material which constitutes a further improvement over what is known in the art.

An additional object of the invention is to provide an improved method of cutting such a stone.

Other objects are to provide a diamond which produces highest brilliance and color, and to provide a cut for gem stones, including gem stones of such precious materials as diamonds, emeralds and Tanzanite, which causes the least possible loss of gem stone material.

In pursuance of these objects, and of others which will become apparent hereafter, one feature of the invention resides in a brilliant-cut jewelry stone of transparent material having a body provided with a gridle and a table parallel thereto, a bezel between the table and girdle and a pavilion below the general plane of the girdle. A first plurality of facets is provided on the bezel and includes an annular facet region whose facets are inclined from the girdle towards the table at angles larger than 50° and up to 90°, and another annular facet region whose facets extend from the first-mentioned region towards the table and are inclined to the girdle at angles smaller than 25°. A second plurality of facets is provided on the pavilion and includes a further annular region of facets which are inclined to the girdle at angles between 25° and 52°.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

The boundary of total reflection is one of the best defined boundaries in physics. As explained already above, the pavilion facets of a brilliant serve to reflect all incident light so that this light will be presented to the viewer as reflections from the brilliant. This object is achieved by all pairs of angles $\phi_1$; $\psi$ within the intransparency area c of FIG. 1.

In the cross-sections of these cuts it may likewise be readily seen that light rays perpendicular of the bezel facets will be lost in the commercial cut but will be reflected again in the inventive cut.

The invention is based on the realization that when the transparency of a brilliant-cut jewelry stone of transparent material is considered in dependence on the angles included by its facets on the bezel and the pavilion, it appears quite surprisingly that the angles of the facets on the bezel must always be smaller than 32.5° or greater than 50° with reference to the general plane of the girdle. All cuts for brilliants which are known in this field, with the exception of the Parker cut which proposes angles of 25.5° for the angles included between the facets on the bezel and the general plane of the girdle, teach angles wherein the facets on the bezel are inclined with reference to the general plane of the girdle at between 33.2° and 41.1°. In these cuts, when light impinges directly vertically upon the table, that is the surface on the bezel which extends in parallelism with the general plane of the girdle, this results in disadvantageous transparency.

Figure 1:
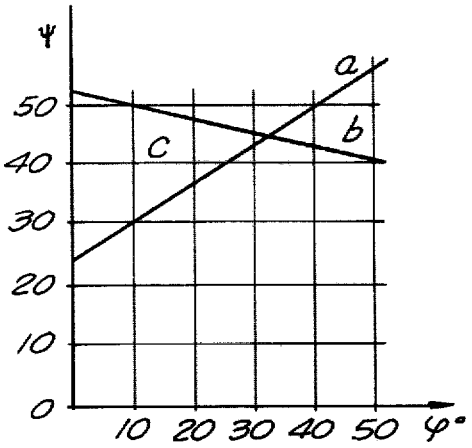
FIG. 1 is a diagram showing the relationship of the angles on the pavilion with reference to the general plane of the girdle in dependence upon the angle of the facets on the bezel with reference to the same plane.

Even more important are the angles at which the facets on the pavilion are inclined with reference to the general plane of the girdle, and reference to FIG. 1 wherein $\psi$ indicates the inclination of the pavilion facets to the general plane of the girdle, will show that the tolerance range—i.e., the range of facet inclination in which the brilliant will be non-transparent to vertically impinging light—increases with a decreasing angle of the facets on the bezel relative to the general plane of the girdle. The same is true of the angle included between the general plane and the facets on the pavilion.

When the bezel facets are provided in two annular regions, one of which extends from the table towards the girdle and the other of which extends from this one region to the girdle, and the facets of this second region are inclined to the table plane at angles greater than 50°, light which impinges on one of these facets normal thereto will be reflected back out of the gem stone at angles of between 16° and 24°, predominantly at 22.5°. The combination of these facets with the facets of the pavilion, reflection angles in the aforementioned ranges are obtained when the incident light enters at angles of between 25° and 90°.

I have found that the greater this tolerance range is, the larger the angle may be under which light impinges against the table of the brilliant-cut jewelry stone without causing the latter to become transparent, that is without causing it to lose its sparkle. The formula developed in 1926 by Johnson does not take this into account and contains no teaching to this effect. The circumstances are similar when the angles included between the general plane of the girdle and the facets on the bezel are greater than 50°.

It has therefore been found in accordance with the invention that in forming the bezel facets, all those angles of the facets with reference to the girdle plane should be avoided which are between 25° and 50°. On the other hand, the facets on the pavilion should include angles of between 25° and 52° with the girdle plane; a range of angles between 45° and 52° is most advantageous. This greatly enhances the sparkle of the stone. In addition, however, my invention has a further advantage of great economical importance. It is a well-known fact that the diameter of a brilliant-cut stone, measured across the girdle in the plane of the latter, determines in any given uncut stone the size which the finished jewelry stone can have, and consequently the weight thereof in carats. For example, for the heretofore customary cuts of brilliants, jewelers' tables state that a brilliant of 0.50 carat will have a girdle diameter of 5.2 mm and a total height— intermediate the culet and the table—of 3.12 mm. In other words, the tables say that if a stone is provided with the conventional brilliant cut and, when finished, is to have a weight of 0.50 carat, the raw stone must be cut until it has the aforementioned dimensions relative to the girdle diameter and height, in order for the cutter to provide it with the facets required by the prior-art brilliant cuts. This, it will be appreciated, predetermines the angles which must be chosen for the facets, if a brilliant cut is to be obtained.

If, however, resort is had to the present invention, utilizing the angles set forth herein for the cut, it is found not only that the brilliance of the stone will be at least the same or usually greater than that achieved with the prior-art cuts, but that also a significant increase in the weight of the finished jewelry stone is obtained. This weight increase, due to smaller losses in the cutting of the raw stone during its conversion into the jewelry stone, is on the order of 10% and higher. In other words, a stone according to the present invention will have a carat weight which is higher by 10% or more than if the same raw stone had been cut in accordance with the prior art.

The actual angles chosen in accordance with the present invention will, of course, be dependent upon the particular shape of the raw stone, and the bezel facets may be either each located above one of the pavilion facets, or circumferentially relative thereto.

The bezel of the stone should always have its facets arranged in form of at least two annuli or annular regions, in one of which the facets are inclined to the table plane at an angle up to 25° and in the other of which they are inclined to the same plane at angles greater than 50°. The first-mentioned annular region could be split into two annuli of facets, one having its facets inclined to the table plane at angles of 11° and the other at angles of 22°. The second-mentioned annular region is of course the one which is adjacent to the girdle plane. Still other angle combination for the facets of the first-mentioned region would be 7°, 15° and 25°, relative to the table plane.

The angle of inclination of the facets in the second annular region is to be greater than 50° and may be as great as 90°; however, 82° has been found to be optimum. In the case of diamonds, 78.5°–82° are most advantageous.

The pavilion facets may also be arranged in more than a single annulus, as pointed out herein.

In FIG. 1 the two lines a and b will be seen to intersect, with the point of intersection being located at 32.5°. The line a indicates those pairs of angles $\phi$, $\psi$ at which the jewelry stone will be transparent when light impinges onto the top of the stone in the direction normal to the table and passes through a bezel facet and an associated pavilion facet, e.g., as shown in FIG. 2*a*. This relationship is given by formula:

$$(\epsilon) = (\phi) - (\alpha) - (\psi) \pm \text{arc}\,\frac{[\sin(\gamma 1)]}{n}$$

but for the purposes of the present discussion the expression $$\text{arc}\,\frac{[\sin(\gamma 1)]}{n}$$

is simply zero and can be ignored,

Wherein:

$\epsilon$ = angle of reflected light $\alpha$ = refracted light $\psi$ = angle of pavilion facets to girdle plane $\gamma_1$ = angle at which light impinging onto the top of the stone is inclined to the central axis of the brilliant $\phi$ = angle of bezel facets to girdle plane.

The line b indicates the pairs of angles at which, respectively reflected via the pavilion facet which is associated with a bezel facet through which light passes, transparency begins e.g., as shown in FIG. 2*b*. This is expressed by the formula $$(\epsilon) = 180^\circ - 3(\psi) - (\phi) + (\alpha) \pm \text{arc}\,\frac{[\sin(\gamma 1)]}{n}$$

but here again for the purposes of the present discussion the last term is simply zero and can be ignored.

Thus, in FIG. 1, the area above line a and below line b, i.e., the triangular intransparency area c, contains only those combinations of the possible values of $\phi$ and $\psi$ for which light incident directly vertically downwards onto the top of the stone will not pass out through the pavilion of the stone and be lost to the viewer (FIG. 2*a*) but instead will be reflected back up through the interior of the stone and emerge from its upper side (FIG. 2*b*) and therefore reach the viewer.

The triangular area c in FIG. 1, located between the lines a and b, shows that the region in which transparency can be avoided will increase, as the angle $\phi$ included between the bezel facets and the general plane of the girdle decreases. Above the intersection of the lines a and b, that is 32.5°, the transparency factors of the two formulae overlap, an occurrence which is true of all prior-art cuts used in brilliants. This means that light passing through the facets of the pavilion due to the transparency of the stone, rather than being reflected e.g., as in FIG. 2*b* is lost to the viewer, e.g., as in FIG. 2*a* with a consequent loss in the inherently possible brilliance of the stone and frequently of the most beautiful color spectra.

Figure 2:
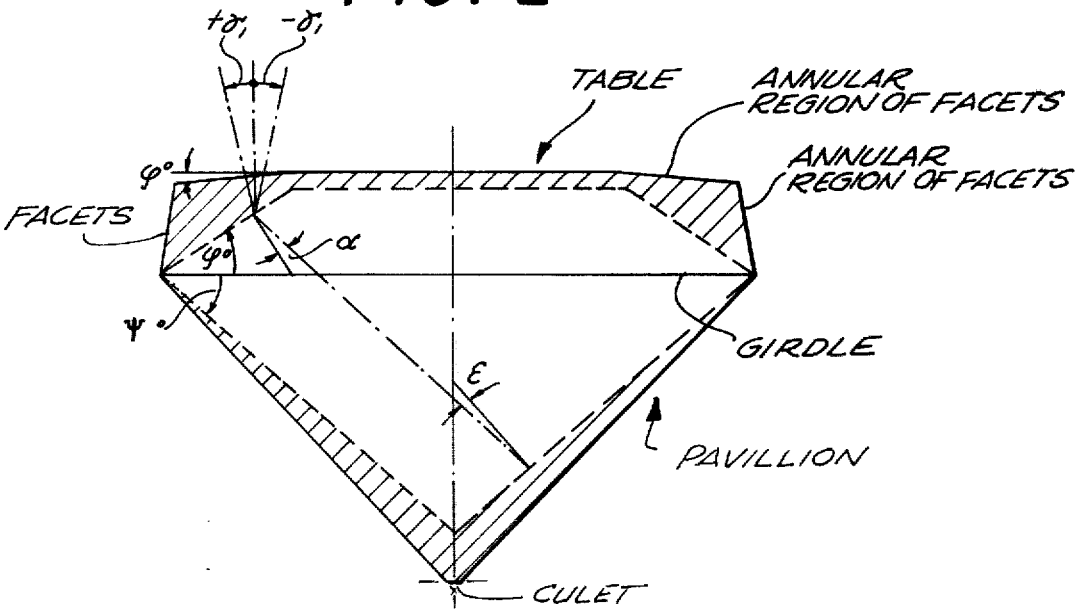
FIG. 2 is a somewhat diagrammatic vertical section, comprising a brilliant-cut jewelry stone according to the invention which is shown hatched, with a stone cut according to the prior art and shown non-hatched.

A consideration of FIG. 2 will show the advantages obtained in terms of a weight increase by resorting to the present invention. The illustrated angles are all evident from what has been set forth above. The non-hatched area surrounded by broken lines in FIG. 2 illustrates the dimensions obtainable for a brilliant which is cut in accordance with the prior art, whereas the shaded area indicates the increased dimensions which are obtained by resorting to the present invention. The significant dimensional increase, and therefore of course carat-weight increase, will be quite evident from the drawing, as will be the fact that the bezel is found with one annular region having facets which extend from the girdle plane towards the table and are inclined to the girdle plane at angles larger than 50°, and another annular region having facets which extend from the one annular region towards the table and are inclined to the girdle plane at angles smaller than 25°.

The present invention also proposes, if the number of facets on the pavilion is an uneven number, to further increase the brilliance of the stone by providing on the bezel a number of facets which is greater than the number of facets on the pavilion and which may be even or uneven. For example, two annular regions of facets could be provided on the bezel, where the facets would be inclined to the jewel plane at angles of 11° and 22°, respectively, and another annular region of facets could be provided at the girdle, having facets inclined to the same plane at an angle greater than 50°. This would result in minimum loss of material due to the cutting. The pavilion could be provided with facets arranged in two annular regions, wherein the facets would be inclined to the aforementioned plane at angles of 44° and 46°, respectively.

It should still be noted that if, as is customary, the facets are arranged in annuli of eight facets each, the increase in weight obtained by resorting to the angles according to the present invention is substantial and highly desirable. If the facets are arranged in even numbers, the bezel facets must be circumferentially offset relative to the pavilion facets.

As disclosed in my aforementioned copending application, the present invention is applicable to gem stones, such as diamonds, which are to be provided with a brilliant cut. I have now also found, however, that my invention is applicable to other transparent materials, as set forth in the following table:

| Material | Refractive Index | Angle of Total Reflection |
|---|---|---|
| Zirconium | 1.93–1.99 | 30°39' |
| YAG (Yttrium Aluminum Garnet) | 1.833 | 33°3' synthetic |
| Monticellite | 1.79–1.84 | 33°30' |
| Korundum | 1.76–1.77 | 34°30' |
| Feldspar | 1.52–1.53 | 40°54' |
| Glass | 1.50 | 41°48' |
| Glass | 1.90 | 31°45' |
| Tannanite | | |
| Synthetic Diamonds | | |
| Fabulite | | |

These are all transparent materials, natural or man-made, which can be used as jewelry stones and provided with the jewelry-cut according to the present invention. Evidently, even in the case of costume jewelry made from paste, and clearly even more so in the case of jewelry made from some of the other materials listed above, an enhanced degree of sparkle is highly desirable inasmuch as it will permit the jewelry stone to more closely approximate and simulate an actual "brilliant", i.e., a brilliant-cut diamond. Thus, the appearance of even costume jewelry can be enhanced and made more appealing by resorting to the present invention.

The economic advantages of the invention, in terms of raw-material savings (compare the hatched and non-hatched silhouettes in FIG. 2) are of course greatest if the raw material is an actual precious gem stone. owever, with at least some of the above-listed materials, including synthetic diamonds, this feature is also of importance since such materials—while certainly not as valuable as actual diamonds—are by no means cheap so that material-savings which can be effected are highly desirable.

It will be understood that each of the elements useful application in other types of gems differing from the types described above.

While the invention has been illustrated and described as embodied in a brilliant-cut stone, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features, that from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An improved jewel made of diamond having a refractive index of 2.4175 and being of brilliant-cut type having a girdle, having a planar table located above and parallel to the plane of the girdle, having a pavilion located beneath the girdle and comprising a circumferential succession of pavilion facets, and having a bezel comprising a first annular region of first bezel facets extending from said girdle towards said table and a second annular region of second bezel facets extending from said first annular region towards said table, the improvement wherein:

each second bezel facet forms an angle $\phi$ with the plane of the table and each pavilion facet below each second bezel facet forms an angle $\psi$ with the plane of the girdle, the points ($\phi$, $\psi$) representing said angle-value combinations in a plot of $\psi$ versus $\phi$ being located within a triangular intransparency region defined by three vertices, the three vertices being ($\phi=0°$, $\psi=24°$), ($\phi=32.5°$, $\psi=44°$) and ($\phi=0°$, $\psi=52°$).

2. The jewel defined in claim 1, the first bezel facets forming angles between 70° and 90° with respect to the plane of the girdle.

3. The jewel defined in claim 1, the number of pavilion facets being even, the number of first bezel facets being even, and the number of second bezel facets being even.

4. The jewel defined in claim 1, the number of pavilion facets being odd, the number of first bezel facets being odd, and the number of second bezel facets being odd.

5. The jewel defined in claim 1, the first bezel facets forming angles between 78° and 81° with the plane of the girdle.

6. The jewel defined in claim 1, wherein said annular regions of facets have even numbers of facets, and wherein the facets of one of said annular regions are offset circumferentially with respect to the facets of the pavillion.

7. The jewel defined in claim 1, wherein $\phi$ is at most equal to 25°.

8. The jewel defined in claim 2, wherein $\phi$ is at most equal to 25°.

9. The jewel defined in claim 3, wherein $\phi$ is at most equal to 25°.

10. The jewel defined in claim 4, wherein $\phi$ is at most equal to 25°.

11. The jewel defined in claim 5, wherein $\phi$ is at most equal to 25°.

12. The jewel defined in claim 6, wherein $\phi$ is at most equal to 25°.

* * * * *